United States Patent [19]

Ohtsu

[11] 4,405,910

[45] Sep. 20, 1983

[54] CONVERGENCE APPARATUS FOR COLOR CATHODE-RAY TUBE

[75] Inventor: Shinji Ohtsu, Tokyo, Japan

[73] Assignee: Denki Onkyo Company Limited, Tokyo, Japan

[21] Appl. No.: 424,186

[22] Filed: Sep. 27, 1982

[30] Foreign Application Priority Data

| | | | |
|---|---|---|---|
| Sep. 25, 1981 | [JP] | Japan | 56-142382[U] |
| Sep. 25, 1981 | [JP] | Japan | 56-142383[U] |
| Sep. 25, 1981 | [JP] | Japan | 56-142384[U] |
| Sep. 29, 1981 | [JP] | Japan | 56-144314[U] |
| Sep. 30, 1981 | [JP] | Japan | 56-145952[U] |
| Jan. 11, 1982 | [JP] | Japan | 57-1872[U] |
| Jan. 18, 1982 | [JP] | Japan | 57-4775[U] |
| May 31, 1982 | [JP] | Japan | 57-81319[U] |
| Jun. 11, 1982 | [JP] | Japan | 57-100162 |

[51] Int. Cl.[3] ..... H01F 7/00

[52] U.S. Cl. ..... 335/210; 335/213

[58] Field of Search ..... 335/210, 212, 213; 313/428

[56] References Cited

U.S. PATENT DOCUMENTS

| | | | |
|---|---|---|---|
| 3,569,881 | 3/1971 | Torsch | 335/210 |
| 4,122,421 | 10/1978 | Malerba . | |
| 4,260,974 | 4/1981 | Nelle | 335/210 |
| 4,339,736 | 7/1982 | Burr et al. . | |

*Primary Examiner*—George Harris

*Attorney, Agent, or Firm*—Armstrong, Nikaido, Marmelstein & Kubovcik

[57] ABSTRACT

In the convergence apparatus which is mounted on a color cathode-ray tube in which three electron beams are in-line arranged, an annular core is fitted to a bobbin which is provided with 12 or 24 segments which isolate the winding sectors of coils, and two groups of 6-pole coils and two groups of 4-pole coils are wound around the winding sectors isolated by the segments. The winding sectors are arranged so that two groups of 6-pole coils are provided to generate magnetic poles at the positions of approximately 30° intervals and two groups of 4-pole coils to do so at the positions of approximately 45° intervals. The core wound with coils is fitted to the edges of circular through holes provided in the terminal plate by using the segments and the specified lead wires of the coils are connected to the printed wires provided on the terminal plate. The terminal plate is attached to the holder mounted with a plurality of ring magnets, and the convergence apparatus is thus constructed in a compact configuration as a whole.

10 Claims, 22 Drawing Figures

CONVERGENCE APPARATUS FOR COLOR CATHODE-RAY TUBE

BACKGROUND OF THE INVENTION

The present invention relates to a convergence apparatus for use in a color cathode-ray tube in which three electron beams are in-line arranged, particularly a convergence apparatus which is capable of performing several types of dynamic convergences and has a compact construction as a whole.

As well known, in case of an in-line type color cathode-ray tube, various kinds of misconvergence take place resulting from dimensional errors in installation of the electron guns and other parts which are caused in manufacturing the cathode-ray tube, spherical profile of a fluorescent screen of the cathode-ray tube and a pattern of deflection magnetic field. Conventionally, therefore, a pair of E type cores are arranged to oppose each other in the in-line direction (horizontal direction) outside the neck of the cathode-ray tube and the cores are respectively wound with coils around their legs, and a horizontal cycle parabola wave current or a sawtooth wave current and/or a vertical cycle parabola wave current or a sawtooth wave current are supplied to these coils to compensate dynamic misconvergence.

However, such convergence apparatus provides only an electromagnetic force in horizontal or vertical direction or horizontal and vertical directions to the electron beams and cannot therefore meet various types of misconvergences. Since a pair of E type cores are employed, it is disadvantageous in that the construction of the convergence apparatus becomes large as a whole and the manufacturing is complicated due to an increase in the number of parts required.

SUMMARY OF THE INVENTION

An object of the present invention is to provide a convergence apparatus which is capable of dynamically and satisfactorily converging three electron beams, which are scattered in various patterns, over the full scope of the fluorescent screen.

Another object of the present invention is to provide a compact and simply constructed convergence apparatus for color cathode-ray tube which is provided with dynamic convergence coil which is made up by toroidally winding a conductor around an annular core and a ring magnet for static convergence which is made up by combining a plurality of magnets.

In the convergence apparatus in accordance with the present invention, the annular core is fitted to a bobbin provided with a number of segments which isolate the winding sectors of the coils, and two groups of 6-pole coils and two groups of 4-pole coils are wound by using these winding sectors. The coil-wound core is fitted to the through hole of the terminal plate by utilizing the segments of the bobbin. The terminal plate is provided with a required number of terminals and the printed wiring which are connected individually and electrically to said terminals or connects the windings one another and the specified lead wires of said coils are connected to corresponding printed wirings. In other words, the coils are connected so that two groups of 6-pole magnetic poles are independently generated with approximately 30° intervals at the specified positions of the annular core in clockwise direction and two groups of 4-pole magnetic poles with approximately 45° intervals at the specified positions of the annular core when a convergence current such as, for example, a current selected from horizontal cycle parabola wave current or sawtooth wave curent and/or vertical cycle parabola wave current or sawtooth wave current is supplied to the coils. The terminal plate is fixed coaxially with the holder, which has a fixing part for fixing the convergence apparatus to the neck of the cathode-ray tube and a plurality of pairs of ring magnets for compensating misconvergence.

DETAILED DESCRIPTION OF THE INVENTION

Figure 1:
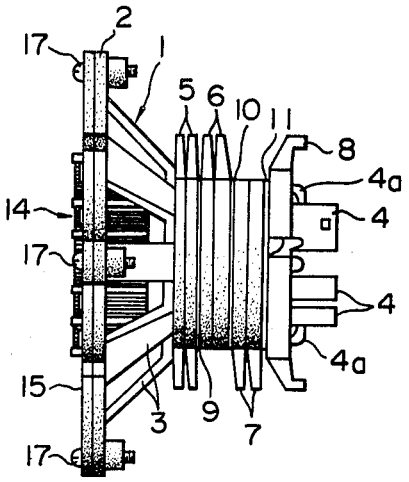
FIG. 1 is a side view of the convergence apparatus for color cathode-ray tube in accordance with the present invention.

In FIG. 1, the front part of the holder 1 of the convergence apparatus is flared to be funnel-shaped and the ring-shaped terminal plate mounting part 2 is supported by a plurality of radially extended frames 3 at the extreme end of the holder. A plurality of retaining members 4 which are extended in the axial direction of the cathode-ray tube for fixing the convergence apparatus on the color cathode-ray tube are provided at the rear part of the holder 1 and the holder 1 is fixed to the neck of the cathode-ray tube by the clamping band which is not shown. The cylindrical part between the retaining members 4 and the frames 3 is provided with pairs of ring magnets 5, 6 and 7 which are rotatable and the spacers 9 and 10 are inserted between two pairs of ring magnets. These pairs of ring magnets 5, 6 and 7 are magnetized to provide, for example, two, four or six magnetic poles and the functions of these pairs of ring magnets are described in detail in the U.S. Pat. No. 3725831. A plurality of pairs of ring magnets 5, 6 and 7 together with spacer 11 are pushed forward the frames 3 by means of the annular lock member 8 to be unrotatable. In other words, for the purpose of adjustment of static convergence, the pushing force applied to the ring magnets is released by rotating the lock member 8 and the ring magnets 5, 6 and 7 are rotated to adjust the static convergence, then fixed by rotating again the lock member 8. For this purpose, four hooks 4*a*, which face outside, are provided between the retaining members 4 while the part of lock member 8 with which the tip ends of these hooks 4*a* contact is tapered to gradually increase its thickness as the lock member 8 rotates.

A disk type terminal plate 15 is fixed with screws 17 to the terminal plate mounting part 2 of the holder 1 and the dynamic convergence coil 14 which is toroidally wound around the core is fastened to the circumferential part along the through hole provided at the center of the terminal plate 15.

Figure 2:
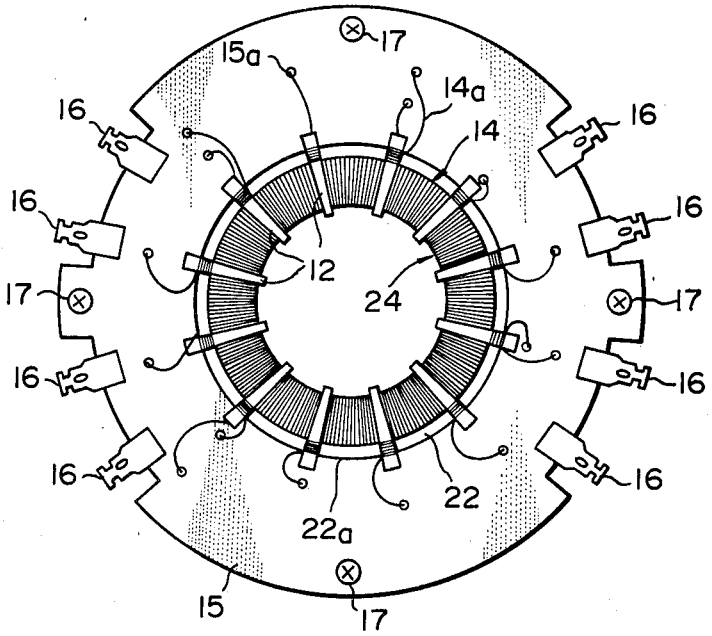
FIG. 2 is a magnified view of the convergence apparatus shown in FIG. 1 as viewed from the screen side.

FIG. 2 shows an example of the dynamic convergence coil. The coil 14 which is toroidally wound is equally divided into twelve winding sectors 24 by twelve segments 12, and two groups of 6-pole coils and two groups of 4-pole coils are wound around the winding sectors. Specified lead wires 14*a* from the coils wound around the winding sectors are entangled with the parts protruded outwardly in the radial directions of the segments 12.

The coil 16 is mounted on the opening 22 provided at the center of the disk type terminal plate 15 and fastened to the internal edge 22*a* of the terminal plate 15. The terminal plate 15 is provided eight terminals 16 on its circumference and the printed wirings are formed on the rear surface of the terminal plate 15 and some of these printed wirings are individually connected with the terminals. The specified lead wires 14*a* are connected to the specified corresponding printed wirings through the through holes 15*a*.

The conductros of coils 14 are wound in the same direction around the winding sectors.

Figure 3:
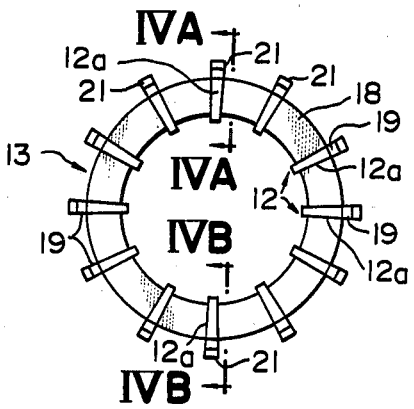
FIG. 3 is a plan view of the bobbin employed in the convergence apparatus of the present invention as viewed from the screen side.
Figure 4A:
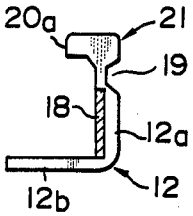
FIG. 4A is a cross sectional view from the arrowhead on the 1-dot broken line IV A—IV A shown in FIG. 3.
Figure 4B:
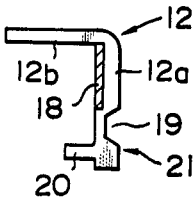
FIG. 4B is a cross sectional view from the arrowhead on the 1-dot broken line IV B—IV B shown in FIG. 3.

In FIG. 3, the bobbin 13 comprises the annular plate 18 and twelve segments 12 which equally divide the bobbin body into twelve winding sectors. The segments 12 are L-shaped as a whole as shown in FIGS. 4A and 4B and the vertical parts 12*a* of said segments 12 are protruded above the surface of the bobbin body 18 and radially extended and located with approximately 30° intervals while the segment bases 12*b* are extended at right angles to the surface of the bobbin body 18 as far as the thickness of the core. The top end of vertical part 12*a* of each segment 12 has the terminal plate fixing part 21 which is provided with the notch 19 with which the lead wire of the coil is fastened and the protrusion 20 which continues to the notch 19. One of twelve segments is constructed to have the protrusion 20*a* whose width is larger than that of other protrusions and which serves as the positioning means for fitting the dynamic convergence coil 16 to the terminal plate 15.

Figure 5:
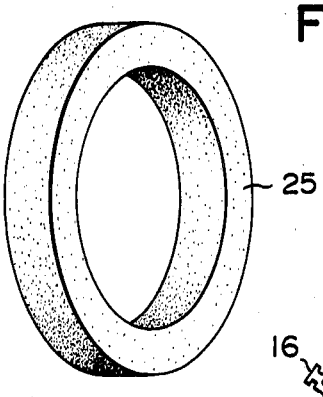
FIG. 5 is a perspective view of the annular core.
Figure 6:
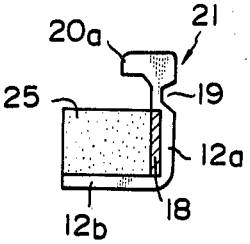
FIG. 6 is a sectional view of the bobbin shown in FIG. 4A to which the annular core is attached.

FIG. 5 shows the annular core to be attached to the bobbin 13. The annular core 25 is made of a soft magnetic material such as ferrite as an annular member with the specified thickness and height and adhered to the bobbin body 18 of the bobbin 13 with a both-face adhesive tape or an adhesive agent as shown in FIG. 6. The instant adhesive commercially sold is used as the adhesive agent for this purpose. The segment base 12*b* of segment 12 of the bobbin 13 serves to axially align the bobbin body 18 and the annular core 25 when they are adhered and also serves as a separator between adjacent winding sectors 24. Since the annular core 25 has only the segment base 12*b* on its internal periphery, the inside diameter of the annular core can be reduced accordingly to result in closer location of the annular core to the electron beams and therefore the sensitivity of the dynamic convergence coil can be improved.

Figure 7:
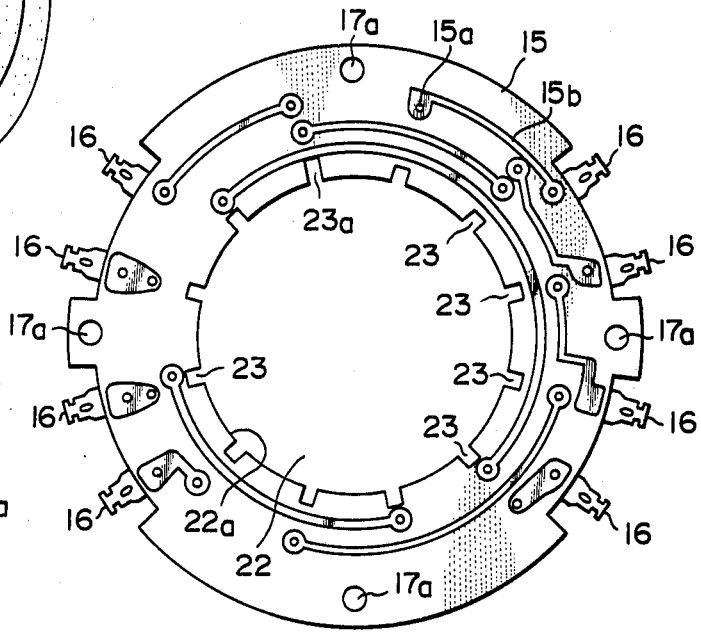
FIG. 7 is an example of the terminal plate for use in the convergence apparatus of the present invention as viewed from the rear.

FIG. 7 is a rear view of the terminal plate 15. Through holes 15*a* are mechanically connected with printed wirings 15*b* and the lead wires passing through holes 15*a* are respectively soldered to the printed wirings 15*b*. Twelve recessions 23 are provided equidistantly on the internal circumference 22*a* of the terminal plate 15 along the center opening 22 and one recession 23*a* is more deeply recessed than other recessions 23. The protrusions 20 and 20*a* shown in FIGS. 4A and 4B are inserted into these recessions 23 and 23*a* and fixed to the terminal plate 15 with an adhesive agent or by thermally melting the parts of protrusions 20, and consequently the dynamic convergence coil 14 is fixed to the terminal plate. In this case, the protrusion 20*a* is inserted into the recession 23*a* only to locate the position of the winding sector of the coil in reference to the hole 17*a* into which the screw 17 is inserted. In addition, the recessions 23, 23*a* are formed to fit the protrusions 20 and 20A.

Figure 8:
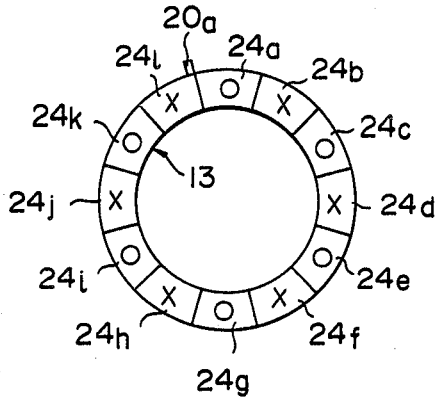
FIG. 8 shows the arrangement of two groups of 6-pole coils for the winding sectors shown in FIG. 2, FIGS. 9A and 9B show an example of the positions of the magnetic poles of two groups of 6-pole coils shown in FIG. 8.
Figure 10:
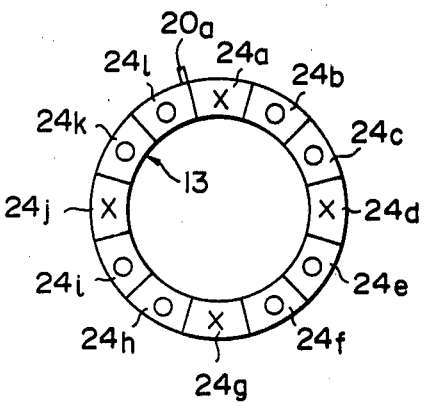
FIG. 10 shows the arrangement of two groups of 4-pole coils for the winding sectors shown in FIG. 2, FIGS. 11A and 11B show an example of the positions of the magnetic poles of two groups of 4-pole coils shown in FIG. 10.

The convergence coil 14 is wound around the annular core 25 mounted on the bobbin 13 for individual winding sectors 24. First, two groups of 6-pole coils capable of generating six magnetic poles are formed by the winding wound around the annular core and then two groups of 4-pole coils capable of generating four magnetic coils are overlaid on two groups of 6-pole coils. FIG. 8 shows the windings of 6-pole coils and FIG. 10 shows the windings of 4-pole coils. The bobbin 13 is divided into twelve equispaced parts as described above and there are formed twelve winding sectors. In other words, twelve winding sectors are numbered as 24*a*, 24*b*, 24*c*, 24*d*, 24*e*, 24*f*, 24*g*, 24*h*, 24*i*, 24*j*, 24*k*, and 24*l* in the clockwise direction in reference to the protrusion 20*a* for positioning.

FIG. 8 shows the windings of 6-pole coils. The first group of 6-pole coils are wound with the same pitches in proper alignment on every other winding sectors 24*a*, 24*c*, 24*e*, 24*g*, 24*i* and 24*k* indicated with o mark and the second group of 6-pole coils are wound similarly on every other winding sectors 24*b*, 24*d*, 24*f*, 24*h*, 24*j*, and 24*l* indicated with x mark. Accordingly, the first group of 6-pole coils are deviated by 30° from the second group of 6-pole coils.

Figure 9A:
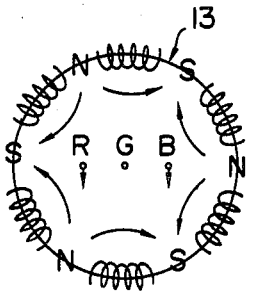

The first group of 6-pole coils generates the magnetic poles at the positions indicated with x mark. If the magnetic poles are generated as shown in FIG. 9A for electron beams R, G and B which are in-line arranged in a horizontal direction when the convergence current is supplied to the coils, the electron beams R and B are shifted downwardly. If the current flow to the coils is reversed, the electron beams are shifted upwardly.

Figure 9B:
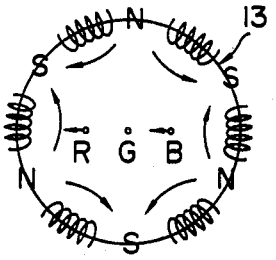

The second group of 6-pole coils generates the magnetic poles at the positions indicated with o mark for electron beams R, G and B as shown in FIG. 9B. Accordingly, the electron beams R and B are shifted leftwardly in a horizontal direction. If the current flow is reversed, the electron beams R and B are shifted to rightwardly.

Figure 18:
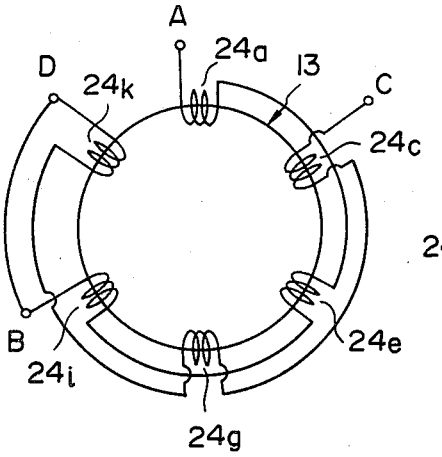
FIG. 18 is an example of the winding method for the 6-pole coil in FIG. 8.

FIG. 18 shows an example of the method of winding of 6-pole coils on the bobbin 13. Generally, the shuttle of the toroidal winding machine for toroidally winding around the annular core performs winding while rotating in the same direction. As shown in FIG. 9A, however, the magnetic flux generated requires that the part of coils are wound in the reverse direction.

Figure 19:
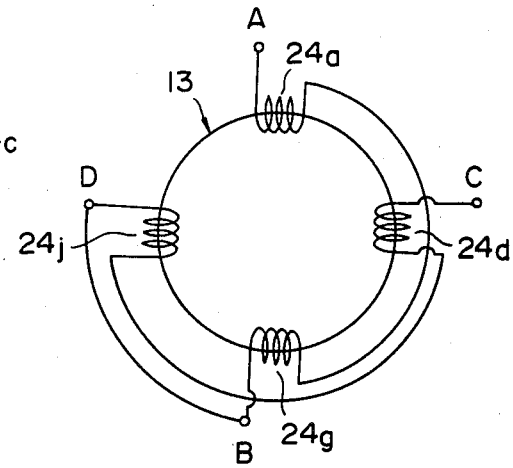
FIG. 19 is an example of the winding method for the 4-pole coil in FIG. 10.

The first group of 6-pole coils is such that the wire is wound starting from the point A of the lead wire around the winding sector 24*a*, continuously around the winding sectors 24*e* and 24*i* and the first winding ends at the point B of the lead wire. Next, the wire is wound around the winding sector 24*c* starting from the point c of the lead wire, continuously around the winding sectors 24*g* and 24*k* and the winding ends at the point D of the lead wire. These lead wires are connected to the printed wirings 15*b* shown in FIG. 7 and consequently points B and D are electrically connected and the points A and C are connected to the terminal 16. When the convergence current is supplied from the points A and C, the magnetic poles are generated as shown in FIG. 19. The lead wires of the winding sectors are extended on and along the outer periphery of the annular core 25 and the direction of the conductor is changed by utilizing the terminal plate fixing part 21 and the segment 37. This is the same with the second group of 6-pole coils.

FIG. 10 shows the windings of 4-pole coils. The first group of 4-pole coils are wound with the same pitches in proper alignment around the winding sectors 24*b*, 24*c*, 24*e*, 24*f*, 24*h*, 24*i*, 24*k* and 24*l* are indicated with o mark and the second group of 4-pole coils are wound similarly around the winding sectors 24*a*, 24*d*, 24*g* and 24*j* indicated with x mark. The first group of 4-pole coils are deviated by 45° in the circumferential direction of the annular core from the second group of 4-pole coils.

Figure 11A:
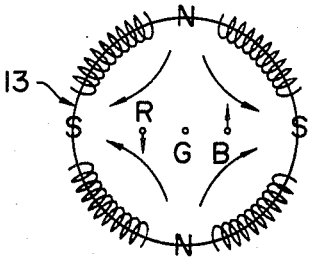

The first group of 4-pole coils generate the magnetic poles in the winding sectors indicated with x mark by virtue of the convergence current. If the magnetic poles are arranged as shown in FIG. 11A for electron beams R, G and B, the electron beam R is affected by the downward magnetic force and the electron beam B by the upward magnetic force to be shifted accordingly. If the current flow is reversed, the electron beams are shifted in a reverse direction.

Figure 11B:
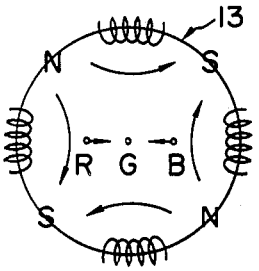

The second group of 4-pole coils generate the magnetic poles in the winding sectors indicated with o mark. If the magnetic poles are formed as shown in FIG. 11*b* when the convergence current is supplied, the electron beams R and B at both sides of the in-line arrangement are shifted toward the electron beam G at the center by a magnetic force. If the current flow in the coils is reversed, the electron beams R and B are shifted in a reverse direction.

FIG. 19 shows an example of the method of winding for the second group of 4-pole coils on the bobbin 13. The winding of 4-pole coils is such that a wire is wound around the winding sector 24*a* starting from the point A of the lead wire and continuously around the winding sector 24*g* and the winding ends at the point B of the lead wire, and subsequently the wire is wound around the winding sector 24*d* starting from the point C of the lead wire and continuously around the winding sector 24*j* and the winding ends at the point D of the lead wire. After this, the points D and B are electrically connected as in case of the 6-pole coils and the convergence current is supplied from the points A and C.

Since the winding around all winding sectors 24 is made in the same direction, the winding work can be quickly and easily performed. Furthermore the winding machine of simple construction can be used.

The number of winding sectors wound with the first group of 4-pole coils is different from that of winding sectors wound with the second group of 4-pole coils. For equalizing the magnetic field intensities both in the first group and the second group, a means for limiting the current flow is added on the inductances of two group of 4-pole coils are made nearly equal. For example, each of the first group of 4-pole coils is wound as many times as 13 turns around each winding sector, the 4-pole coil of the second group is to be wound as many times as 20 turns around the winding sector.

As described above, the convergence magnetic field generated by the 6-pole coils and the 4-pole coils does not nearly affect the center electron beam G of electron beams in in-line arrangement and shifts electron beams at both sides. When the convergence current is supplied to the convergence coils, the convergence of three electron beams and satisfactory pictures are obtained all over the screen during the raster scanning period.

Figure 12:
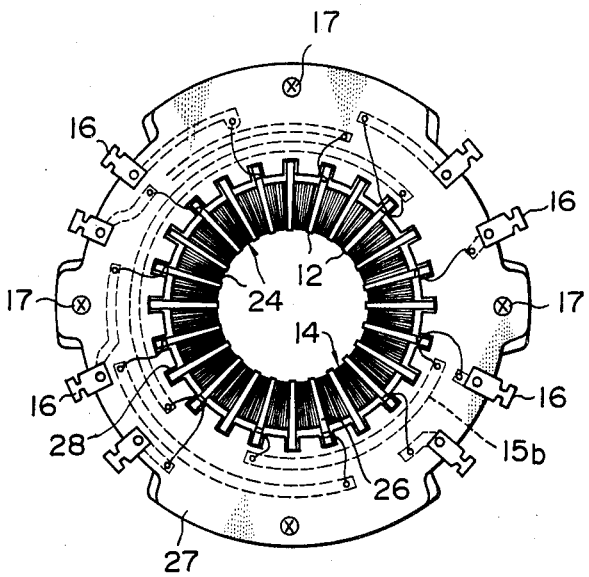
FIG. 12 is a plan view of the convergence apparatus of another embodiment of the present invention as viewed from the screen side, FIGS. 13 and 14 respectively show the relative arrangement of two groups of 6-pole coils and two groups of 4-pole coils for the winding sectors shown in FIG. 12.
Figure 13:
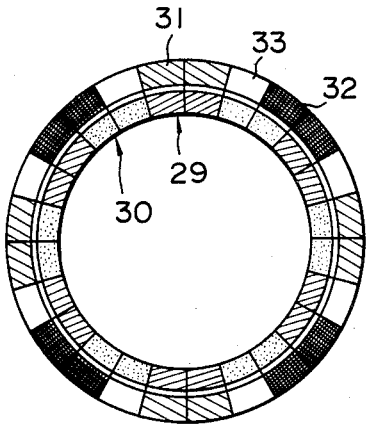
Figure 14:
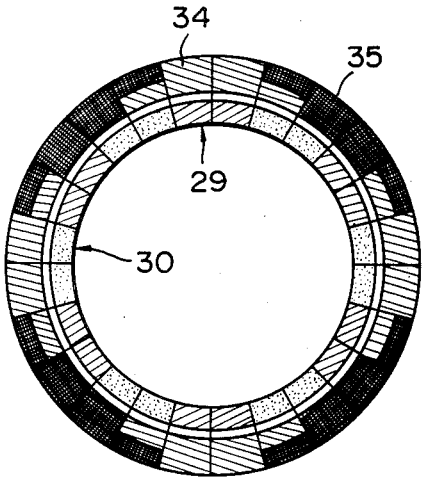

FIG. 12 shows another embodiment in accordance with the present invention. This embodiment differes from the embodiment shown in FIG. 2 in that 24 segments 26 are provided at equal-angle positions as the winding is divided into 24 winding sectors two times the number of winding sectors in the latter embodiment and the recessions 28 corresponding to these winding sectors are provided in the internal periphery of the terminal plate 27. As the 6-pole coils to be wound in the lower layer, the first group of 6-pole coils is wound continuously to two adjacent winding sectors as shown in FIGS. 13 and 14. The second group of 6-pole coils is similarly wound. The merit of provision of 24 winding sectors is obtained from winding the 4-pole coils. As shown in FIG. 13, one winding sector 33 around which the 4-pole coil is not wound is provided between the first group and the second group of 4-pole coils which are wound continuously to two adjacent winding sectors. Accordingly, only the 6-pole coil is wound around the winding sector 33. If the convergence apparatus is constructed as described above, the number of turns of the first group of 4-pole coils can be made equal to that of the second group of 4-pole coils, the winding work is facilitated and a uniform distribution of magnetic flux is obtained. The 4-pole coils can be wound as shown in FIG. 14. In this example, the first group of 4-pole coils 34 and the second group of 4-pole coils 35 are equally wound around the winding sector 33 shown in FIG. 13.

Figure 15:
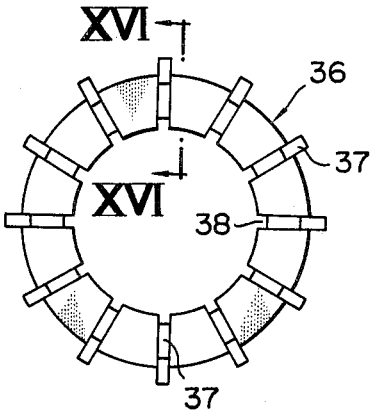
FIG. 15 shows an embodiment of the rear-side bobbin combined with the bobbin shown in FIG. 3.
Figure 16:
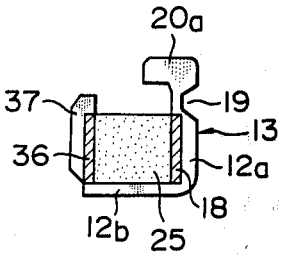
FIG. 16 is a sectional view of the bobbin shown in FIG. 15 which is combined with the bobbin shown in FIG. 3 and is further fitted with the core, as viewed in the arrowhead direction at the position shown with the 1-dot broken line in FIG. 15.

FIG. 15 shows another embodiment of the present invention and the rear bobbin 36 which is attached by an adhesive to the other side of the annular core 25 which faces the bobbin body 18. This figure shows the rear bobbin as viewed from the opposite side to the bobbin body 18. Twelve protruded segments 37 are provided at equal angular distances in the circumferential direction. The recessions 38 are provided at the segments 37 on the internal periphery of the rear bobbin 36 and engaged with the tip ends of segment bases 12*b* of the segments 12 when the bobbin 36 is combined with the bobbin 13 and the annular core 25 as shown in FIG. 16. Therefore the relative angular positions of the segments 12 and the segments 37 coincide on the plane passing through the axial line of the annular core, and the winding sector is divided by three planes. If the apparatus is constructed as described above, the coils to be wound around all winding sectors are wound in proper alignment and the distribution of generated magnetic flux becomes uniform.

Figure 17:
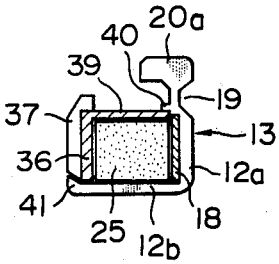
FIG. 17 is a sectional view showing another embodiment of the rear-side bobbin shown in FIG. 16.

FIG. 17 shows another embodiment of the rear-side bobbin. This figure is a sectional view of the rear-side bobbin as viewed from the similar position shown in FIG. 16. This embodiment differes from FIG. 16 in that the cylindrical part 39 which covers the outer periphery of the annular core 25 is provided integral with the rear-side bobbin 36, the recession which engages with the engaging protrusion 40 provided integral with the segment 12*a* on the lower part of the protrusion 20*a* is formed at the edge of the cylindrical part, and the hook part 41 is formed at the tip end of the segment base 12*b*. This construction is advantageous in that bobbins 13 and 36 need not be bonded to the annular core 25 and proper winding sectors are obtained only by combining the bobbins 13 and 36.

These embodiments can conform to the embodiment shown in FIG. 12. The preferred embodiments of the present invention are not limited to the examples described above and can be modified in details as required by the inventor.

What is claimed is:

1. A convergence apparatus for color cathode-ray tube, which is provided with electron guns which emit three electron beams in in-line arrangement toward a screen of said color cathode-ray tube at its neck part where said electron beams are deflected and scanned on said screen by a deflection yoke mounted on said neck part, comprising:

(a) a first bobbin which is annular in shape and has a flat plate, said bobbin being provided with 12N (N is an integer) segments which are radially extended on said annular plate and located to divide the circumference of said annular plate into 12N parts to form 12N winding sectors, said segments being extended outside the radial direction to respectively provide thereon a terminal plate fixing part and being provided with a segment base on the inner end part of the radial direction of said segment as being extended in a direction at right angles to said annular plate, (b) an annular core made of a magnetic material to be mounted on said bobbin, (c) two groups of 6-pole coils which are toroidally wound around said annular core by use of said winding sectors divided by said segments, said two groups of 6-pole coils being formed to generate six magnetic poles independently at positions with equidistance of approximately 30° therebetween in a circumferential direction of said annular core when a convergence current is supplied, (d) two groups of 4-pole coils which are toroidally wound around said annular core by use of said winding sectors divided by said segments, said two groups of 4-pole coils being formed to generate four magnetic poles independently at positions with equidistance approximately 45° therebetween in a circumferential direction of said annular core when a convergence current is supplied, (e) a terminal plate which has a through hole into which said bobbin can be accommodated, said terminal plate being provided with a number of recessions in its internal circumference to fix said bobbin to the terminal plate by engaging the terminal plate fixing part of said bobbin with said recessions, and (f) a holder which engages with said terminal plate to support said terminal plate on the neck of said cathode-ray tube, said holder supporting said 6-pole coils and 4-pole coils at the specified position of said neck of the cathode-ray tube in a specified arrangement.

2. A convergence apparatus for color cathode-ray tube in accordance with claim 1, wherein said holder is provided with a cylindrical part which is provided with a plurality of sets of ring magnets one set of which consists of one pair of ring magnets.

3. A convergence apparatus for color cathode-ray tube in accordance with claim 1, wherein said terminal plate fixing part is provided with a plurality of recessions for fastening the predetermined lead wires of said coils and a plurality of recessions provided in the internal circumference of said terminal plate along said through hole.

4. A convergence apparatus for color cathode-ray tube in accordance with claim 3, wherein only one protrusion of the plurality of said protrusions of the terminal plate fixing part is provided as a special protrusion which is different from other protrusions and only one of said recessions of the terminal plateis constructed to fit said special protrusion.

5. A convergence apparatus for color cathode-ray tube in accordance with claim 1, wherein a printed wiring is formed on at least one surface of said terminal plate and the specified lead wires of said coils are connected to said printed wirings.

6. A convergence apparatus for color cathode-ray tube in accordance with claim 1, wherein said 6-pole coils and 4-pole coils are wound around a plurality of winding sectors, which are expected to be wound with conductors in the same direction and the group of coils with the same magnetic polarity are continuously wound, thereby these two groups of coils are connected to provide opposite polarities.

7. A convergence apparatus for color cathode-ray tube in accordance with claim 1, wherein said first bobbin is arranged to face a second bobbin having an annular flat plate with said core intervened therebetween and said second bobbin is provided with a plurality of segments, which are radially extended, corresponding to the segments of said first bobbin.

8. A convergence apparatus for color cathode-ray tube in accordance with claim 7, wherein the internal circumference of the annular plate of said second bobbin is provided with the recessions, which engage with the tip ends of the segment bases of said first bobbin, at the positions corresponding to the segments and said segments are formed as being protruded from the external circumference of said annular plate.

9. A convergence apparatus for color cathode-ray tube in accordance with claim 7 or 8, wherein the cylindrical part for covering the outer periphery of said annular core is provided integral with said second bobbin.

10. A convergence apparatus for color cathode-ray tube in accordance with claim 9, wherein an engaging means for engaging with said first bobbin is provided on the edge of said cylindrical part.

* * * * *